United States Patent [19]

Morton et al.

[11] 4,089,509

[45] May 16, 1978

[54] COMPOSITION CONTROL SYSTEM FOR AN ASPHALT PLANT

[75] Inventors: James L. Morton, Eden Prarie, Minn.; Thomas H. Birchell, Livermore, Calif.; James M. Noble, Alamo, Calif.; David W. Jenson, Lafayette, Calif.

[73] Assignee: Seltec Corporation, Fremont, Calif.

[21] Appl. No.: 813,067

[22] Filed: Jul. 5, 1977

[51] Int. Cl.[2] ..... B28C 7/04

[52] U.S. Cl. ..... 366/8; 366/17

[58] Field of Search ..... 366/4, 16–18, 366/27–29, 33, 34, 42, 43, 49, 150–154

[56] References Cited

U.S. PATENT DOCUMENTS

| | | | |
|---|---|---|---|
| 3,263,971 | 8/1966 | Farnham | 366/16 |
| 3,614,071 | 10/1971 | Brock | 366/4 |
| 3,809,373 | 5/1974 | Brock | 366/18 |

*Primary Examiner*—Leonard D. Christian
*Attorney, Agent, or Firm*—Jones, Thomas & Askew

[57] ABSTRACT

A system for preparing asphalt mix of a selected composition is disclosed wherein the correct proportions of various grades of aggregate to be mixed with liquid asphalt are maintained by repeatedly measuring the weight of aggregate contribution from each of a plurality of feed bins containing different grades of aggregate, comparing the proportion of the total aggregate from all of the feed bins contributed by each individual feed bin to a preselected desired proportion for the particular grade of aggregate contained in that feed bin, and responsive to said comparison, adjusting the rate of feeding of aggregate from that feed bin to correct the actual proportion of the total agregate from that feed bin to the preselected desired proportion. The comparison and adjustment steps are repeated at a selected interval and the proportions of aggregate from each bin are determined based on the average output of each bin over the same interval. If an upward adjustment beyond the feed rate capacity of a particular feed bin is required, the output of the remaining feed bins is proportionately reduced until the maximum output of the particular feed bin provides a proportion of the total output of aggregate consistent with the desired composition of the asphalt mix.

19 Claims, 1 Drawing Figure

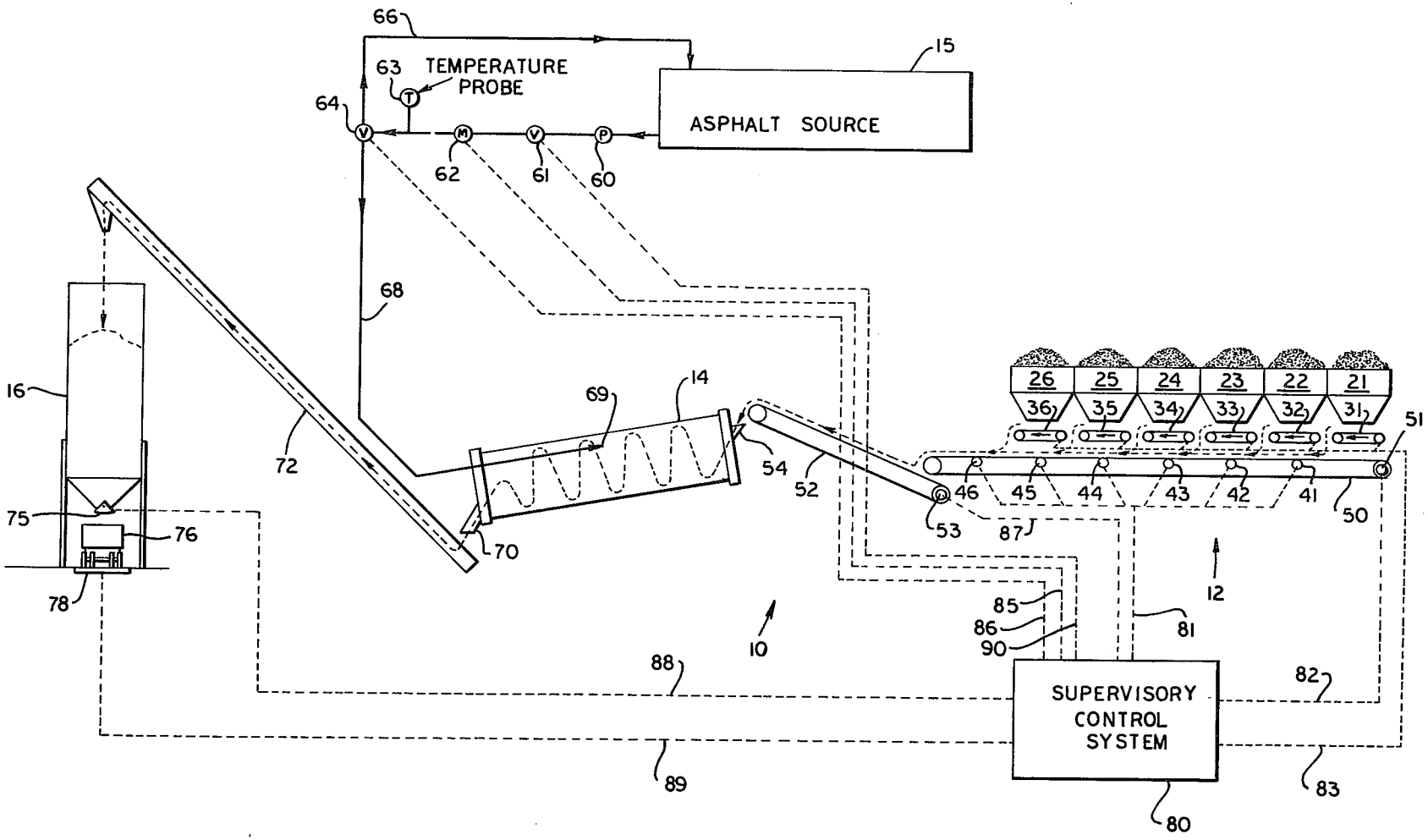
ASPHALT SOURCE
TEMPERATURE PROBE
SUPERVISORY CONTROL SYSTEM

COMPOSITION CONTROL SYSTEM FOR AN ASPHALT PLANT

BACKGROUND OF THE INVENTION

The present invention relates to drum mix asphalt plants and to a system for controlling the composition of asphalt mix prepared in such a plant.

Continuous drum mix asphalt plants are generally supplied with aggregate from a plurality of cold feed bins containing aggregate of different grades, ranging from course to fine, and with liquid asphalt which is to be mixed with the aggregate. Each cold feed bin is generally equipped with a variable speed belt feeder which deposits aggregate from the feed bin onto a conveyor which passes underneath all of the feed bins and deposits the combined output of the feed bins into a combination dryer and drum mixer, where liquid asphalt is mixed with the aggregate.

In the past, to obtain an asphalt mix of a particular composition, the plant operator would normally select a desired total mix output in tons per hour and then manually set the speed of each variable speed belt feeder to the speed which, under optimal and unvarying conditions, would provide the proper amount of aggregate from its feed bin to form the desired proportion of the total tons per hour of aggregate. A single idler scale along the main conveyor following all of the feed bins was usually used to monitor the total amount of aggregate from all of the feed bins entering the drum mixer. If for any reason one of the belt feeders jammed or partially clogged or for any other reason provided more or less aggregate than would normally be expected for the set belt speed, the operator of the drum mix plant would only become aware of a slight change in the total amount of aggregate entering the drum mixer but had no way of knowing how the composition of the mix had changed. Only if the change were so great as to be visually noticeable was it possible to determine which feeder was responsible for the change in total output. Such a lack of control over the composition of the asphalt mix was very disadvantageous, especially in jobs where tight government specifications for the mix were to be met.

In some prior art systems, individual idler scales have been provided along the main conveyor following each cold feed bin. When individual idler scales are provided along the conveyor, the upstream feed bins deliver aggregate onto the conveyor, said aggregate becoming part of the tare weight for all of the downstream idler scales to be taken into account in determining the weight of aggregate being contributed by downstream feed bins.

It is believed that means have been provided in such prior art systems for manipulating the weights measured by the idler scales to determine roughly the weight of aggregate being delivered from each feed bin, calculating whether the correct proportion is being delivered by said feed bin, and changing the feeding rate from said feed bin by an arbitrary amount. However, such systems are believed to have lacked the capability to adjust the feeding rate of said feed bin by an amount related to the amount of error in the proportion, and further to have lacked the capability to store weight information in order to delay use of said information until the aggregate which it represents has reached downstream idler scales. Without the last-mentioned capability the tare weight added to downstream idler scales by aggregate from upstream feed bins must be taken to be the signal received simultaneously from the upstream idler scales. Thus, the proportion of aggregate contributed by downstream feed bins cannot be precisely determined with certainty since it is necessary to assume that the additional tare weight being delivered from upstream feed bins has remained constant during the time required for aggregate measured by upstream idler scales to reach downstream idler scales. This assumption will not hold true if the upstream feeding rate changes for some reason so that the aggregate weighed by the upstream idler scales does not weigh the same as the aggregate approaching the downstream idler scales.

Other attempts to control the composition of asphalt mix, such as that disclosed in U.S. Pat. No. 3,625,488, have involved complicated sampling devices which add significantly to the cost of an asphalt plant.

SUMMARY OF THE INVENTION

The present invention solves the above problems by providing an asphalt plant, and a method of operating an asphalt plant, wherein the composition of asphalt mix is automatically maintained in the proper proportions.

Generally described, in a system of preparing asphalt mix of a selected composition including feeding selected amounts of aggregate from a plurality of variable output feed bins containing aggregate of various grades onto a delivery means, delivering the aggregate into a mixing drum, adding liquid asphalt to the mixing drum, mixing the aggregate and the liquid asphalt with the mixing drum, and thereafter delivering the mix to a storage silo, the present invention comprises measuring the weight of aggregate being delivered to the delivery means by each of the feed bins; comparing the proportion of the sum total of the measured weights attributable to each of the feed bins to a preselected desired proportion for each bin; and, responsive to the actual proportion attributable to each feed bin being larger or smaller than the desired proportion for each bin, decreasing or increasing, respectively, the rate of feeding of aggregate from each bin onto the delivery means by an amount sufficient to adjust the actual proportion being delivered from each bin to the desired proportion for that bin.

Thus, an object of the present invention is to provide a drum mix asphalt plant and method for operating said plant wherein a selected composition of asphalt mix prepared by said plant remains constant.

A further object of the present invention is to provide a control system and method for operating an asphalt plant whereby the proportion of each grade of aggregate in the asphalt mix may be accurately determined and adjusted to maintain a selected composition of the mix.

BRIEF DESCRIPTION OF THE DRAWING

The FIGURE is a schematic representation of a continuous drum mix asphalt plant according to the disclosed embodiment of the present invention.

DESCRIPTION OF THE PREFERRED EMBODIMENT

The present invention may be used in connection with a continuous drum mix asphalt plant 10 such as is shown diagrammatically in the FIGURE, wherein an aggregate supply system 12 supplies aggregate via conveyors 50 and 52 to an inlet chute 54 of a combination dryer and drum mixer 14 in which the aggregate is dried and mixed with liquid asphalt from a liquid asphalt storage tank 15. After mixing, the asphalt mix exits the drum mixer through an outlet chute 70 and is carried by a slat conveyor 72 to a storage silo 16 from which the stored mix may be dispensed through a discharge gate 75 into a waiting truck 76 positioned on a truck scale 78. The progress of aggregate through the plant is shown by unreferenced dotted arrows.

The aggregate supply system 12 includes a plurality of cold feed bins 21–26 each containing a different grade of aggregate, ranging from coarse to fine. Each cold feed bin includes a variable speed belt feeder 31–36 which feeds aggregate from its respective cold feed bin at a selected rate onto conveyor 50. Directly following the point along the conveyor 50 at which each belt feeder delivers aggregate from its feed bin are associated idler scales 41–46, respectively, for measuring the weight of aggregate on the conveyor 50 passing over each idler scale. Thus it may be seen that as each belt feeder adds aggregate from its respective feed bin, the amount and weight of aggregate on the conveyor 50 successively increases, adding weight to the tare weight of downstream idler scales. The idler scales 41–46 therefore provide output signals which correspond to the successive increases in weight on the conveyor.

The conveyors 50 and 52 are equipped with tachometers 51 and 53, respectively for monitoring the speed of conveyors 50 and 52. However, the speed of conveyors 50 and 52 is usually fixed during operation of the asphalt plant, and the production rate of the asphalt plant is varied by changing the rate of feeding from feed bins 21–26 by belt feeders 31–36.

Liquid asphalt from the liquid asphalt storage tank 15 is withdrawn by a constant speed pump 60 and delivered via an asphalt feed line 68 to a delivery point 69 within the drum mixer 14 where the liquid asphalt is introduced into the drum mixer 15 and mixed with the aggregate. In addition to the pump 60, the asphalt feed line 68 also includes an asphalt flow meter 62 for measuring the flow of asphalt out of the storage tank 15, a proportioning valve 61 for varying the flow of liquid asphalt into the drum mixer 14, and a directional valve 64 for selectively directing the flow of liquid asphalt through an asphalt return line 66 back into the storage tank 15.

A supervisory control system 80 is provided to utilize information received from the idler scales 41–46 to adjust the composition of aggregate being delivered to the drum mixer 14 by the belt feeders 31–36. The output signals from the idler scales 41–46, corresponding to weights of aggregate at corresponding locations on the conveyor 50, are transmitted to the control system 80 along an input channel 81, and similarly the input signals from the asphalt meter 62 and the conveyor tachometers 51 and 53 are transmitted to the control system 80 along input channels 85, 82 and 87, respectively. Control system 80 also includes outgoing control channel 83 for transmitting control signals to individually vary the feeding rate of belt feeders 31–36, outgoing control channel 90 for transmitting signals to control the proportioning valve 61, and outgoing control channel 86 for transmitting signals to control the position of the directional valve 64. The supervisory control system can also receive signals from the truck scale 78 and can transmit signals along the outgoing control channel 88 to control the operation of the discharge gate 75 in the silo 16, so as to control dispensing of the asphalt mix in addition to the mix preparation.

To initiate operation of an asphalt plant controlled according to the disclosed embodiment of the present invention, the control system 80 is provided with input signals by the operator corresponding to the total desired production rate in tons per hour and to the proportions of that production rate desired to come from each of the feed bins 21–26. The control system 80 calculates the tons per hour required from each belt feeder to make up the total production rate with the desired proportions of different grades of asphalt, and determines from known calibration data for the belt feeders the speed at which each belt feeder should be operated to provide the required tons per hour. The control system 80 then signals belt feeder 31 to begin feeding aggregate from feed bin 21 onto conveyor 50 at the speed determined to provide the correct amount of aggregate from feed bin 21. After a time delay depending on the distance between belt feeders 31 and 32 and on the speed of the conveyor 50 as measured by the tachometer 51, the control system 80 signals belt feeder 32 to begin delivering aggregate from feed bin 22 onto the conveyor 50 which already holds aggregate from feed bin 21 at that point. This delayed start-up sequence continues until all of the feed bins from which aggregate is desired for the particular asphalt mix are operational. It will also be understood that the delayed start-up sequence avoids the waste or improperly-proportioned aggregate which would occur if all of the belt feeders were started simultaneously.

The control system 80 receives weight signals from the idler scales 41–46 along input channel 81 as often as several times per second. It will be seen that the weight signal from each of the idler scales includes an increased tare weight comprising the weight of the aggregate from all of the upstream feed bins preceding the particular idler scale as well as the weight of the aggregate from the feed bin associated with said idler scale. The control system 80 stores the signal received from each idler scale for the period of time required for the aggregate on the conveyor 50 to travel from each idler scale to the next downstream idler scale. This time period is readily determined since the fixed speed of the conveyor 50 and the distance between idler scales are known. It will be assumed, for the purpose of explanation, that the stored signal was received from idler scale 42. When the aggregate which was weighed by the idler scale 42 reaches the idler scale 43, additional aggregate has been added by the belt feeder 33 immediately preceding the idler scale 43. The control system 80 receives a signal from the idler scale 43 and subtracts therefrom the stored signal corresponding to the weight of aggregate measured at the idler scale 42 earlier, thereby determining the net weight of the aggregate added by the belt feeder 33 at the time.

Thus, the control system 80 does not determine the weight of aggregate contributed by the belt feeder 33 by taking the signal from the idler scale 43 and subtracting the simultaneous signal received from the idler scale 42. Instead, the signal transmitted from the idler scale 42 when it sensed the weight of the aggregate now passing over the idler scale 43 provides a true tare weight signal which is subtracted from the signal transmitted from the idler scale 43. By delaying the subtraction of upstream aggregate contributions in this manner, a much more precise measurement of the aggregate contributed by the belt feeder 33 from feed bin 23 is obtained than was possible using prior art systems.

The signal from the idler scale 43 is then stored for the period of time required for the aggregate measured by the idler scale 43 to reach the idler scale 44, at which point the stored signal is used in the manner described above to determine the precise weight of aggregate added to the conveyor 50 by belt feeder 34. In this manner, the contributions from all of the feed bins are repeatedly determined at very short time intervals and are individually stored for use in adjusting the composition of the asphalt mix as will be described hereinafter.

At selected longer time intervals, generally selected to be from one to ten seconds, the control system 80 compares the average weight of aggregate being delivered from each individual feed bin averaged over said longer time interval, to the average total weight of aggregate being delivered to the drum mixer 14, and thereby determines the actual proportion of the particular grade of aggregate stored in the particular feed bin in the total weight of aggregate. This actual proportion is then compared by the control system 80 to a predetermined desired proportion for the particular grade of asphalt in the particular feed bin which was previously selected by the operator of the asphalt plant in order to make up the desired composition of the final asphalt mix.

If the actual proportion for a particular feed bin varies from the desired proportion, the control system 80 signals the belt feeder associated with that particular feed bin to increase or decrease the output of the belt feeder in response to the signal so as to correct the proportion of that particular grade of aggregate to the desired proportion. It has been found advantageous to utilize an iteration technique in so correcting the proportions of aggregate whereby the feed rate correction signaled by the control system 80 is only a selected fraction of the amount of correction needed to fully correct the proportion being delivered from a particular feed bin. After several iterative adjustments, the proportion closely approaches its proper value while the possibility of overcorrecting or oscillating back and forth between over and under correction is generally minimized or avoided.

The control system 80 makes corrections to the proportion of aggregate being contributed by each of the feed bins in use at each selected longer interval continuously while the plant is in operation. Although the belt feeders are initially set at feeding rates which are intended to give a particular total production rate in tons per hour, the control system maintains the composition of the aggregate entering the drum mixer 14, rather than the production rate of the asphalt plant. Thus, if upon comparing the actual proportion and the desired proportion for a particular feed bin, the control system determines that the required correction is beyond the maximum speed of the belt feeder associated with that feed bin, the control system will decrease the speed of all of the other belt feeders appropriately so that the maximum speed of the particular belt feeder delivers the desired proportion for that feed bin at a lower overall output rate. When the overall output rate of aggregate is thus decreased, the control system also signals liquid asphalt valve 64 to decrease appropriately the amount of liquid asphalt being pumped through line 68 into drum mixer 14 after a time delay sufficient to allow the point along the conveyor at which the overall aggregate output rate was changed to reach the liquid asphalt delivery point 69 within the drum mixer 14.

Thus it will be seen that in an asphalt plant operated according to the present invention if the aggregate within one of the feed bins does not flow out of the feed bin freely, or if through some malfunction one of the belt feeders does not deliver aggregate at the rate expected for the speed at which the belt feeder is set, the control system 80 senses a variance from the correct composition of aggregate entering the drum mixer 14 and corrects the composition so as to contain the desired proportions of various grades of aggregate, even if it is necessary to lower the overall production rate.

If it is desired to change the composition of the asphalt mix or the production rate during continuous operation of the asphalt plant, a procedure essentially identical to the start-up procedure described above is used. The control system determines the belt feeder speeds required to give the new proportions and new production rate. However, rather than simultaneously changing the speeds of belt feeders 31–36, they are converted to appropriate new speeds after a time delay as described above which allows the aggregate of altered composition from upstream feed bins to reach a particular feed bin before delivery rate of the the particular feed bin is converted. The delay procedure allows for conversion to a new mix with essentially no waste.

The idler scales 41–46 may be easily calibrated in an asphalt plant according to the present invention. An even flow of aggregate from the first feed bin 21 is passed in sequence over all of the idler scales for a carefully measured period of time, and is diverted at the end of the conveyor 50 into a truck or other container instead of being delivered into the drum mixer 14. The truck is then weighed and the weight of aggregate therein determined. The weight of aggregate in the truck divided by the time during which aggregate was delivered gives a tons per hour figure which is assigned to the average output signal of the idler scale 41 for the particular speed at which the conveyor 50 was running. The averaged signals from the idler scales 42–46 during the test period are also assigned values related to the value assigned to idler scale 41. The assigned values are then used as a reference against which signals received from the idler scales during operation of the system may be compared.

The control system 80 may be embodied in a general purpose programmable computer or a microprogrammed computing apparatus, which may be best suited to perform the averaging and iterative procedures described above. The selection and programming of such computers to accomplish the system and its operation as described herein are well within the abilities of a person of ordinary skill in the art. However, such a computer is not essential to the asphalt plant control system of the present invention, and other devices capable of performing the tasks of the control system 80 are within the scope of the invention.

For example, the storing and delayed use of weight signals from upstream idler scales in order to provide precise tare weights for downstream idler scales, as described above, may be carried out by a digital shift register. However, such a shift register would have to be uneconomically large to be able to store and shift the large number of signals which are transmitted during the time required for one of said signals to become part of the tare weight of the next downstream idler scale. The procedure is much more efficiently carried out by storing the signals in the memory of a programmed computer and then "reading" the information stored at each memory location at the appropriate time.

While this invention has been described in detail with particular reference to preferred embodiments thereof, it will be understood that variations and modifications can be effected within the spirit and scope of the invention as described hereinbefore and as defined in the appended claims.

What is claimed is:

1. An asphalt plant comprising:

a mixing drum;

means for delivering aggregate to said mixing drum including a plurality of feed bins for delivering aggregate of varying grades of coarseness;

means for delivering liquid asphalt to said mixing drum;

means for sensing the weight of aggregate being delivered from each of said plurality of feed bins; and control means operatively connected between said sensing means and said aggregate delivery means for comparing the proportionate weight of aggregate being delivered from each of said feed bins to a predetermined desired proportion for each feed bin, and responsive to said actual proportion being other than said desired proportion, adjusting the rate of delivery of aggregate from each of said disproportionate feed bins to the desired proportion.

2. The asphalt plant of claim 1 wherein said sensing means is a first sensing means, and further comprising:

a second sensing means, operatively connected to said aggregate delivery means by said control means, for providing a signal when the adjustment of one of said feed bins required in response to comparison of the actual and desired proportions of aggregate from each of said feed bins in order to restore said desired proportions is beyond the maximum output of said one of said feed bins; and wherein said control means, in response to a signal from said second sensing means, is operative to reduce proportionately the rate of delivery from all of said feed bins until the maximum output of said one feed bin delivers the desired proportion from said one feed bin.

3. The asphalt plant of claim 1 wherein:

said aggregate delivery means includes a conveyor successively collecting aggregate from each of said feed bins;

said sensing means includes a plurality of scales operatively associated with said conveyor downstream of each location along said conveyor at which a feed bin delivers aggregate to said conveyor, said scales being operatively connected to said control means for transmitting signals to said control means; and said control means includes:

means for storing signals from said scales for a time equal to the time required for the aggregate corresponding to said stored signal to travel on said conveyor to the next downstream scale; and means for subtracting said stored signal from the signal transmitted by said next downstream scale to accurately determine the weight of aggregate added to said conveyor by the feed bin located between said scales.

4. The asphalt plant of claim 3 wherein said control means includes means for altering the composition of asphalt produced by said plant, said composition altering means including:

means for converting each feed bin in turn to a rate of delivery corresponding to the new desired proportion for said feed bin; and means for delaying the conversion of the next successive feed bin until aggregate delivered at the new rate by the next preceding feed bin onto said conveyor has reached said next successive feed bin.

5. An asphalt plant comprising:

a mixing drum;

conveyor means for delivering aggregate to said mixing drum including a plurality of feed bins for delivering aggregate of varying grades of coarseness onto said conveyor;

means for delivering liquid asphalt to said mixing drum;

first sensing means including a plurality of scales operatively associated with said conveyor downstream of each location along said conveyor at which a feed bin delivers aggregate to said conveyor for sensing the weight of aggregate being delivered from each of said plurality of feed bins; and control means operatively connected between said sensing means and said aggregate delivery means for storing signals from each of said scales for a time equal to the time required for the aggregate corresponding to said stored signal to travel on said conveyor to the next downstream scale;

subtracting said stored signal from the signal transmitted by said next downstream scale to accurately determine the weight of aggregate added to said conveyor by the feed bin located between said scales;

comparing the proportionate weight of aggregate being delivered from each of said feed bins to a predetermined desired proportion for each feed bin; and, responsive to said actual proportion being other than said desired proportion, adjusting the rate of delivery of aggregate from each of said disproportionate feed bins to the desired proportion.

6. In a method of preparing asphalt mix of a selected composition including feeding selected amounts of aggregate from a plurality of variable output feed bins containing aggregate of various grades at a plurality of rates onto a delivery means, delivering said amounts of aggregate into a mixing drum, adding liquid asphalt to said mixing drum, mixing said aggregate and said liquid asphalt within said mixing drum, and thereafter delivering said mix to a storage silo, the improvement comprising the steps of:

A. measuring the weight of aggregate being delivered to said delivery means by each of said plurality of feed bins;

B. comparing the proportion of the sum total of said measured weights attributable to each of said plurality of feed bins to a preselected desired proportion for said bin; and C. responsive to said actual proportion attributable to each of said bins being larger or smaller than the desired proportion for said bin, decreasing or increasing, respectively, the rate of feeding of aggregate from said bin onto said delivery means by an amount sufficient to adjust the actual proportion from said bin to the desired proportion.

7. The method of claim 6 wherein said steps are continuously repeated while mix is being prepared.

8. The method of claim 7 wherein said comparison and adjusting steps are repeated at selected intervals and wherein said comparison step utilizes a proportion based on the average of the total weight of aggregate from said feed bins over the selected interval and the average weight of aggregate attributable to each feed bin over the selected interval.

9. The method of claim 7 wherein said selected interval is from 1 to 10 seconds in length.

10. The method of claim 6 wherein said adjustment step comprises decreasing or increasing the rate of feeding of aggregate from said feed bin by a selected fraction of the amount necessary to adjust the actual proportion from said bin to the desired proportion.

11. The method of claim 10 wherein said steps (A)-(C) are repeated continuously at a selected interval.

12. The method of claim 6 wherein said adjusting step includes:

providing a signal when the increase required in the rate of feeding from a particular feed bin would raise the rate of feeding from said bin beyond its maximum rate; and responsive to said signal, decreasing the output rates of all of said plurality of feed bins other than said particular feed bin proportionately until the maximum output of said particular feed bin equals the desired proportion of the total aggregate weight assigned to said feed bin.

13. The method of claim 12 wherein said outputs of said other feed bins are decreased proportionately a selected fraction of the amount needed to make the maximum output of said particular feed bin equal the desired proportion assigned to said feed bin.

14. The method of claim 13 wherein said step of decreasing the output of said other feed bins is periodically repeated.

15. The method of claim 12 wherein the rate of feeding of liquid asphalt into said mixing drum is reduced proportionately corresponding to the reduction in total production occurring when the output rates of all of said feed bins other than said particular feed bin are reduced, said liquid asphalt reduction occurring after a delay sufficient to allow the aggregate delivered at the reduced production rate to reach said mixing drum.

16. The method of claim 6 wherein said delivery means comprises a conveyor running under said feed bins successively collecting aggregate from each feed bin, and wherein said step of measuring the weight being delivered to said conveyor from each feed bin includes subtracting the weight of aggregate added by upstream feed bins which is passing adjacent said feed bin at the particular time the weight added by said feed bin is being determined from the total weight of aggregate present on said conveyor adjacent said feed bin at said particular time.

17. The method of claim 16 wherein prior to carrying out said steps, scales for weighing the output of said feed bins are calibrated by opening the first of said feed bins to a fixed feeding rate for a particular period of time;

collecting and weighing the aggregate dispensed by said first feed bin in said time period; and assigning the tons per hour derived from the weight of the collected aggregate during said time period to the average of output signals transmitted by each of said scales over said time period to provide a reference against which future signals transmitted by said scales may be compared.

18. The method of claim 16 further comprising the steps of:

selectively converting in turn the rate of feeding of each of said feed bins to a new rate corresponding to a desired proportion of a new asphalt mix composition; and, alternately, delaying the conversion of the next successive feed bin until aggregate delivered at the new rate by the next preceding feed bin onto said conveyor has reached said next successive feed bin.

19. In a method of preparing asphalt mix of a selected composition including feeding selected amounts of aggregate from a plurality of variable output feed bins containing aggregate of various grades at a plurality of rates onto a conveyor means, delivering said amounts of aggregate into a mixing drum, adding liquid asphalt to said mixing drum, mixing said aggregate and said liquid asphalt within said mixing drum, and thereafter delivering said mix to a storage silo, the improvement comprising the steps of:

A. measuring the weight of aggregate being delivered to said conveyor by each of said plurality of feed bins by subtracting the weight of aggregate added by upstream feed bins which is passing adjacent each feed bin at the particular time the weight added by said feed bin is being determined from the total weight of aggregate present on said conveyor adjacent said feed bin at said particular time;

B. comparing the proportion of the sum total of said measured weights attributable to each of said plurality of feed bins to a preselected desired proportion for said bin; and C. responsive to said actual proportion attributable to each of said bins being larger or smaller than the desired proportion for said bin, decreasing or increasing, respectively, the rate of feeding of aggregate from said bin onto said delivery means by an amount sufficient to adjust the actual proportion from said bin to the desired proportion.

* * * * *